US005542461A

United States Patent [19]

Huang

[11] Patent Number: 5,542,461

[45] Date of Patent: Aug. 6, 1996

[54] SAFETY TASSEL FOR PULL CORDS

[75] Inventor: Chung-Chen Huang, Taipei, Taiwan

[73] Assignee: Teh Yor Industrial Co., Ltd., Taipei, Taiwan

[21] Appl. No.: 302,306

[22] Filed: Sep. 8, 1994

[51] Int. Cl.[6] ..... E06B 9/38

[52] U.S. Cl. ..... 160/178.1; 24/115 F; 24/602

[58] Field of Search ..... 160/178.1 R, 178.1 V, 160/168.1 R, 168.1 V, 173 R, 173 V, 320; 16/114 B, 122, 217, 218, DIG. 12; 24/136 R, 115 M, 115 F, 114.5, 136 L, 129 R, 128, 122.6, 602; 428/28

[56] References Cited

U.S. PATENT DOCUMENTS

| | | | |
|---|---|---|---|
| 515,155 | 2/1894 | Nelson | 24/136 L |
| 1,225,623 | 5/1917 | Hall et al. | 24/129 R |
| 2,164,206 | 6/1939 | Gits et al. | 24/128 R |
| 4,635,698 | 1/1987 | Anderson | 160/178.2 R |
| 4,728,560 | 11/1988 | Keller | 24/115 M |
| 4,909,298 | 3/1990 | Langhart et al. | 24/114.5 |
| 4,967,824 | 11/1990 | Colson et al. | 160/178.2 R |
| 5,058,650 | 10/1991 | Morris | 160/168.1 R |
| 5,473,797 | 12/1995 | Wu | 160/178.2 X |

*Primary Examiner*—David M. Purol
*Attorney, Agent, or Firm*—Pro-Techtor International

[57] ABSTRACT

A safety tassel for pull cords, used in a venetian blind for example. The safety tassel includes an eccentric hole to secure with one of the cords and one or more slots to releasably engage the other cords. When a child is entangled in the cords, the cords will be automatically released.

10 Claims, 4 Drawing Sheets

FIG ,1 PRIOR ART

SAFETY TASSEL FOR PULL CORDS

BACKGROUND OF THE INVENTION

This invention relates to a safety tassel for pull cords used in venetian blinds and other things.

Conventionally, in the tassel 111 of the pull cords 112, 112' for a venetian blind, as depicted in FIG. 1, the ends of said cords 112, 112' are knotted so that the cords 112 112' are firmly retained within said tassel 111. If by accident, a little boy or girl becomes entangled in the cords 112, 112' while playing, the cords will not be automatically released.

SUMMARY OF THE INVENTION

It is a primary object of the present invention to provide a safety tassel for pull cords such that any little child is aught by the cords, said cords will be automatically released to avoid any injury.

This object is attained with a safety tassel for pull cords comprising, fixed engaging means to fixedly engage one of the cords and one or more removable engaging means to releasably engage with other cords. The distance between said fixed engaging means and said removable engaging means is much shorter than the normal size of a human neck, so that as soon as said cords are tangled around the neck of a child, said cord will be automatically pulled off the removable engaging means to avoid the risk of injuring the neck.

The aforementioned and other objects, features, and advantages will be understood in light of the following detailed description in connection with the accompanying drawings in which like reference symbols designate like parts throughout the figures,

DETAILED DESCRIPTION OF THE PREFERRED EMBODIMENTS

Figure 1:
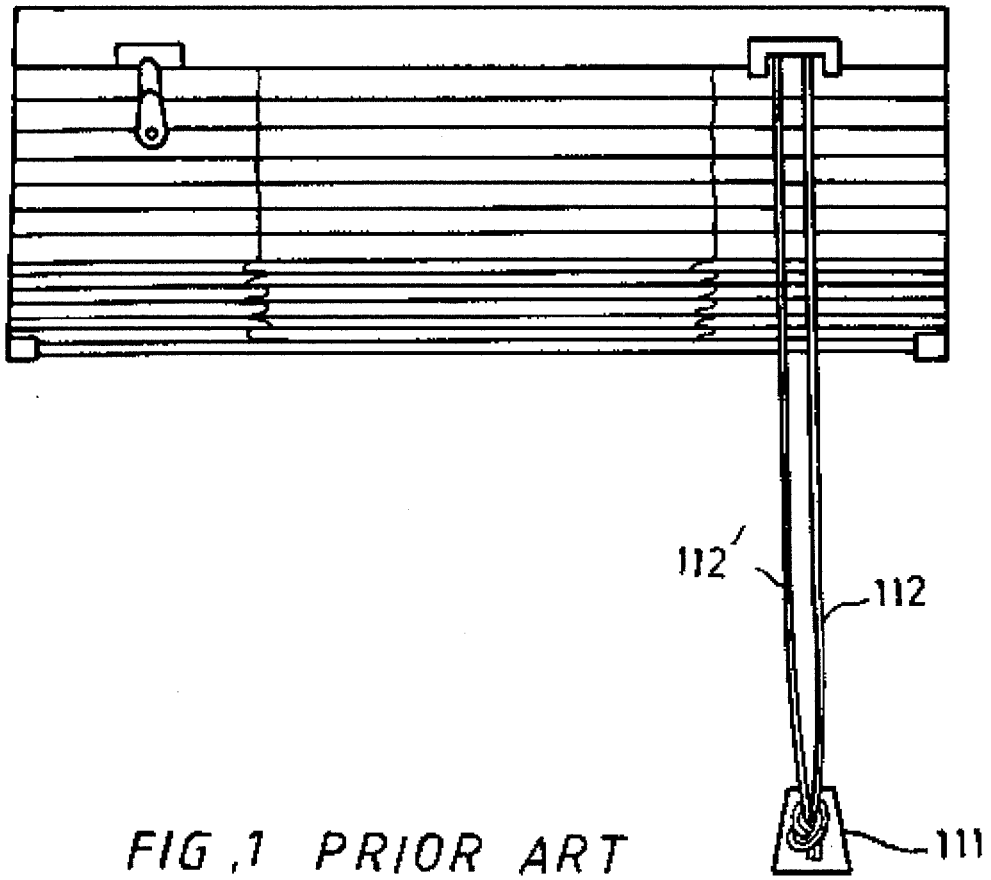
FIG. 1 is a front view of the conventional tassel of the pull cords used in a venetian blind.
Figure 2:
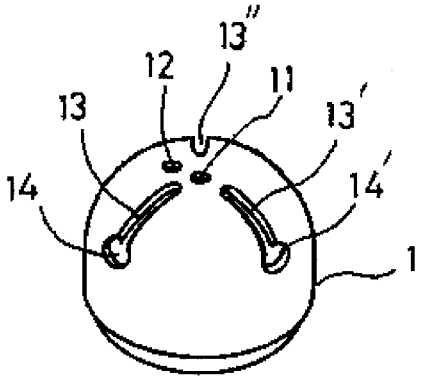
FIG. 2 is a perspective view of the safety tassel according to a first embodiment of the present invention.
Figure 3:
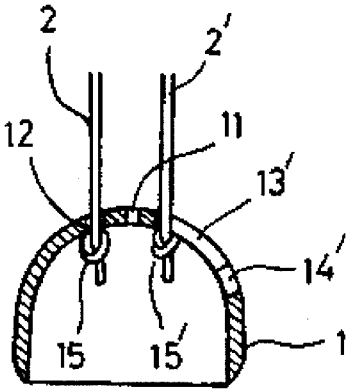
FIG. 3 is a cross sectional view of the first embodiment with the cords engaged therein.
Figure 4:
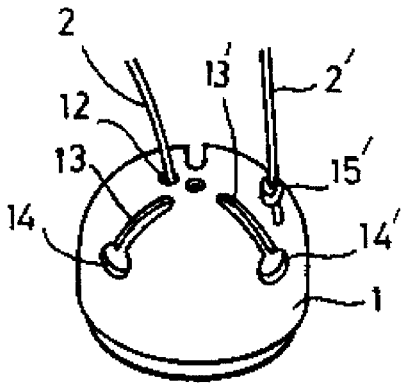
FIG. 4 is similar to FIG. 2, but with one of the cords retained and another pulled off.

Reference is made to FIGS. 2 to 4 which illustrate the safety tassel of the pull cords according to the first embodiment of the present invention. The present tassel has a bell-like cap 1. On the cap there are provided a central hole

11 and an eccentric hole 12 as the fixed engaging means. There is at least one slot (three slots 13, 13' and 13" spaces 120 degrees apart as shown) with an enlarged opening 14 an outer end as removable engaging means. If two cords 2, 2' are used, a first cord 2 is passed through the slot 13'. Both cords 2, 2' are knotted at their terminal ends (as shown in FIG. 2) to be retained in the hole 12 and slot 13'. The size of the knot 15' is greater than the width of the slot 13' so that it is positively retained inside of the cap 1, but is smaller than the diameter of the enlarged opening 14'. Preferably, the width of said slots is about the same as the diameter of said cords or even slightly smaller to restrict movement of said cords within said slots.

Since the distance between said eccentric hole 12 and said slot 13' is much shorter than the normal size of any human neck, if the cords 2, 2' are looped over the neck of a little child, then one of the cords 2 would be still fixedly engaged with the hole 12 while another cord 2' must be displaced outward. This causes the knot 15' to escape out of said opening 14' so that the cord 2' is pulled out of the cap 1 as shown in FIG. 4. In this case the cord 2' will not combine with the cord 2 to cause any harm to the child.

Alternatively, when four cords are used (not shown), one of the cords is passed through the central hole 11, while the other three cords are passed through the three slots 13, 13', 13", respectively. The distance between the central hole 11 and any one of slots 13, 13' and 13" is even shorter than that between the eccentric hole 12 and the slot 13', so that knots in the cords 2' are pulled out of the enlarged openings if a child becomes entangled in the pull cord.

Of course, the cap 1 can be formed with either only the eccentric hole 12 and one slot 13' or only the central hole 11 with three slots 13, 13' and 13" instead of the combination of one central hole 11 and one eccentric hole 12 and all three slots 13, 13' and 13" as illustrated in FIGS. 2–4.

Figure 5:
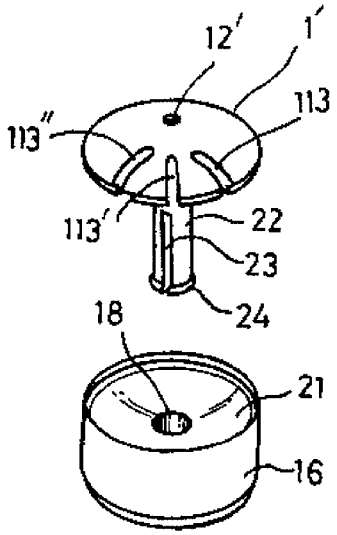
FIG. 5 is an exploded perspective view of the safety tassel according to a second embodiment of the present invention.
Figure 6:
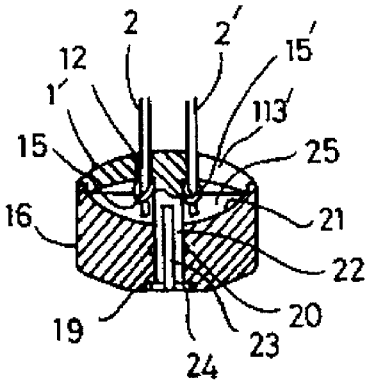
FIG. 6 is a cross sectional view of the second embodiment in assembled state.
Figure 7:
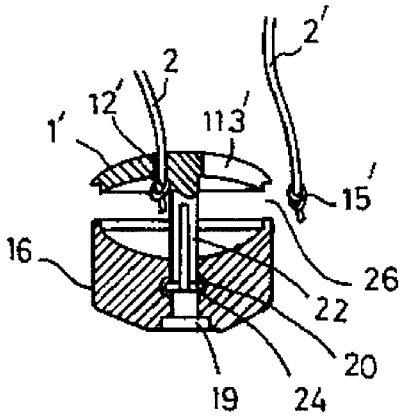
FIG. 7 is similar to FIG. 6, but the cap is raised with one of the cords retained and another removed.

Next, reference is made to FIGS. 5 to 7 which illustrate the safety tassel of the pull cord according to a second embodiment of the present invention. The tassel of this embodiment is composed of a seat 16 and a cap 1'. The seat 16 has a central bore 18 formed with an annular lower groove 19 and a middle groove 20 at a bottom and an intermediate section thereof, respectively, around said bore 18. The seat 16 has a concave top surface 21. The cap 1' has a dome-like configuration provided at a bottom surface thereof with a central insert 22 having a longitudinal slit 23 extending through an end flange 24. On the dome of said cap 1' there is an eccentric hole 12' and at least one slot extending radially around the periphery of said cap.

As mentioned with reference to the first embodiment, the first cord 2 is passed through the eccentric hole 12' as the fixed engaging means while the second cord 2' is passed through the slot 113' as the removable engaging means, if two cords are used, or other cords (not all shown) are passed through the slots 113, 113' and 113", respectively, if four cords are used. The cords 2, 2' are similarly knotted at respective ends just as in the first embodiment.

Then, said cap 1' is assembled with said seat 16 by inserting said insert 22 into said bore 18 to the maximum extent that said end flange 24 is fitted into said lower groove 19 and, said cap 1' just covers said seat 16 with a space 25 formed under said cap 1' and above said concave top surface 21 sufficient to receive the knots 15, 15' therein.

If a child becomes entangled in the cords 2, 2' the cap 1 is pulled upward so that said end flange 24 is stripped off said lower groove 19 and moved to fit into said middle groove 20. Cap 1 is thus raised with respect to said seat 16 so that an opening 26 is formed therebetween. The size of the opening 26 is greater than the size of the knot 15'. Therefore, the cord 2' is automatically removed from the cap.

Figure 8:
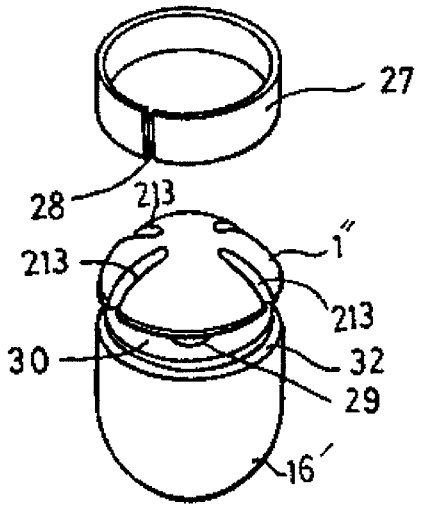
FIG. 8 is an exploded perspective view of the safety tassel according to a third embodiment of the present invention.
Figure 9:
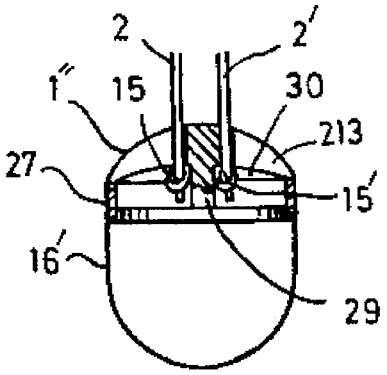
FIG. 9 is a partial cross sectional view of the third embodiment in assembled state.
Figure 10:
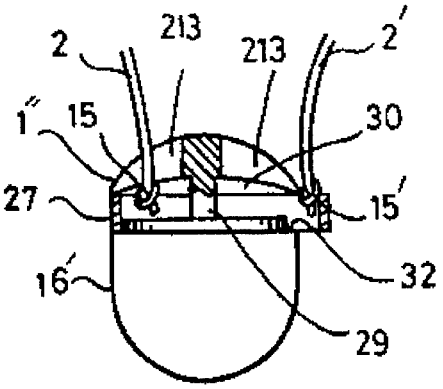
FIG. 10 is similar to FIG. 9, but the collar is elastically extended with one of the cords retained and another removed.

Finally, reference is made to FIGS. 8 to 10 which illustrate the safety tassel of the pull cords according to a third embodiment of the present invention. The tassel of this embodiment comprises an unitary body composed of a cap 1" and a seat 16', and a collar 27 which is openable at a seam 28. The seat 16' and the cap 1" are formed as a unit interconnected by a central stud 29 so that an annular opening 30 is formed therearound to receive the knots 15, 15'.

In said cap 1" there is formed at least a pair of slots 213 in diametrical positions in which one of said slots 213 in the pair is served as the fixed engaging means and the other as the removable engaging means. Two pairs of said slots 213 are illustrated. At an upper end of said seat 16' there is preferably formed an annular shoulder 32 for fitting said collar 27 therearound. Said collar 27 thus closes the opening 30 to retain said knots 15, 15' therein.

When the cords 2, 2' are accidentally looped over the neck of a child, said cords 2, 2' are extended outward by the child's neck to apply a force against said collar 27. The collar 27 opens at the position of said seam 28 to expose the opening 30. Normally, the cord engaged in the slot 13 that is closer to said seam 28 is pulled through the opening 30 and removed out of said collar 27 while the other cord will be still retained therein.

Other modifications of the aforementioned embodiments are also possible. For example, in the first and second embodiments, four orthogonal slots can be formed as in the third embodiment, instead of three slots. Then said eccentric hole and/or central hole can be eliminated. In other words, the fixed engaging means are eliminated, and only removable engaging means are provided. In this case, as soon as one of the cords is pulled off, other cards will be still retained in the place. If two or more cords are pulled off, the safety measure is more effective.

While there have been shown and described what are at present considered the preferred embodiments and modifications of the present invention, it will be obvious to those skilled in the art that a number of changes and variations may be made without departing from the scope of the invention as defined by the appended claims.

What I claim is:

1. A safety tassel for pull cords, comprising:

a cap and a seat, said seat has a central bore with an annular lower groove at a lower end thereof and a middle groove at an intermediate portion thereof, said seat further has a concave top surface, and said cap has a dome-like configuration provided at a bottom surface thereof with a central insert having a longitudinal slit extending through an end flange, said cap includes at least two engaging means in a top portion thereof, said engaging means receiving said pull cords, a free end of each of said cords is passed through one of said engaging means and a knot is tied in a terminal end of each of said cords, said knot restricting said cords from being withdrawn from said engaging means, and said cap and said seat are assembled by inserting said central insert into said bore so that said end flange is fitted into said lower groove and said cap closely covers said seat.

2. The safety tassel of claim 1 wherein;

one of said engaging means is an eccentric hole and another of said engaging means is a radial slot.

3. The safety tassel of claim 2, wherein;

said cap includes at least three radial slots.

4. The safety tassel of claim 2, wherein;

an enlarged opening is between said cap and said seat when said cap is raised by an internal force with respect to said seat so that said end flange is pulled out of said lower groove and forced into said middle groove.

5. The safety tassel of claim 3, wherein;

an enlarged opening is between said cap and said seat when said cap is raised by an internal force with respect to said seat so that said end flange is pulled out of said lower groove and forced into said middle groove.

6. A safety tassel for pull cords, comprising:

a unitary body comprising a cap and a seat, a collar openable at a seam thereof, said cap includes at least two engaging means in a top portion thereof, said engaging means receiving said pull cords, a free end of each of said cords is passed through one of said engaging means and a knot is tied in a terminal end of each of said cords, said knot restricting said cords from being withdrawn from said engaging means, and wherein said cap and said seat are connected by a central stud, and said seat has an annular shoulder at an upper end thereof to receive said collar and to enclosed said central stud.

7. The safety tassel of claim 6, wherein;

said engaging means are a pair of radial slots, with an open end at a periphery of said cap.

8. The safety tassel of claim 6, wherein;

said engaging means includes at least two pairs of radial slots, said pairs of slots being arranged in an orthogonal manner.

9. The safety tassel of claim 7, wherein;

an opening is created when a force is exerted on said collar through said cords such that said seam in said collar is opened.

10. The safety tassel of claim 8, wherein;

an opening is created when a force is exerted on said collar through said cords such that said seam in said collar is opened.

* * * * *